US005496791A

United States Patent [19]

Ohno et al.

[11] Patent Number: 5,496,791

[45] Date of Patent: Mar. 5, 1996

[54] THERMAL TRANSFER IMAGE-RECEIVING SHEET

[75] Inventors: Akihiko Ohno; Takatoshi Nishizawa; Akira Iwai; Ayako Shibata, all of Ibaraki, Japan

[73] Assignee: Oji Yuka Goseishi Co., Ltd., Tokyo, Japan

[21] Appl. No.: 328,522

[22] Filed: Oct. 25, 1994

[30] Foreign Application Priority Data

Dec. 21, 1993 [JP] Japan ..... 5-344692

[51] Int. Cl.[6] ..... B41M 5/035; B41M 5/38

[52] U.S. Cl. ..... 503/227; 428/195; 428/206; 428/319.9; 428/328; 428/913; 428/914

[58] Field of Search ..... 8/471; 428/195, 428/206, 319.9, 328, 913, 914; 503/227

[56] References Cited

U.S. PATENT DOCUMENTS 4,778,782 10/1988 Ito et al. ..... 503/227
5,196,391 3/1993 Ohno et al. ..... 503/200
5,268,349 12/1993 Ohno et al. ..... 503/227
5,306,690 4/1994 Ohno et al. ..... 503/227

*Primary Examiner*—B. Hamilton Hess
*Attorney, Agent, or Firm*—Sughrue, Mion, Zinn, Macpeak & Seas

[57] ABSTRACT

A thermal transfer image-receiving sheet comprising (1) a support comprising (a) a surface layer comprising a biaxially stretched film of a thermoplastic resin containing from 2 to 60% by weight of titanium dioxide fine powder and (b) a base layer comprising a biaxially stretched microporous film of a thermoplastic resin containing from 10 to 45% by weight of an inorganic fine powder and (2) an image-receiving layer provided on surface layer (a) of support (1), in which support (1) has a void volume of from 30 to 60% and a density of from 0.50 to 0.78 g/cm$^3$, and surface layer (a) of support (1) has a center-line average roughness of not more than 0.5 μm and a Bekk's smoothness of from 4,000 to 100,000 sec. The thermal transfer image-receiving sheet has an excellent cushioning effect due to the number of microvoids present in the support thereof and high sensitivity in a middle tone region owing to the titanium dioxide present in the surface layer of the support to provide a clear image having a high density even with reduced printing energy.

8 Claims, 3 Drawing Sheets

THERMAL TRANSFER IMAGE-RECEIVING SHEET

FIELD OF THE INVENTION

The present invention relates to a thermal transfer image-receiving sheet and more particularly to a thermal transfer image-receiving sheet having high sensitivity to provide a clear dye image of high density even with reduced printing energy.

BACKGROUND OF THE INVENTION

Thermal transfer recording is generally carried out by heating a thermal transfer recording material, called an ink ribbon, comprising a support having thereon a color forming layer containing a subliming or vaporizing dye thereby to sublimate or vaporize the dye and transferring the dye to an image-receiving sheet to form a dye image.

More specifically, as shown in FIG. 3 of the accompanying drawings, transfer recording material 1 composed of support 4 and color forming layer 5 and thermal transfer image-receiving sheet 2 composed of thermal transfer image-receiving layer 6 and support 7 are brought into contact between drum 12 and electrically controlled heating source 3, such as a thermal head. Color forming layer 5 of transfer recording material 1 is thus heated by heat source 3 to sublimate or vaporize the dye contained therein, and the sublimated or vaporized dye is transferred to image-receiving layer 6 to accomplish thermal transfer recording.

The material constituting image-receiving layer 6 depends on the kind of the color former (dye) to be transferred thereto. For example, in using a heat-fusible color former, support 7 per se can serve as an image-receiving layer. In using a subliming disperse dye as a color former, a coat layer comprising a high polymer, such as a polyester, may be used as an image-receiving layer.

Support 7 of image-receiving sheet 2 includes pulp paper, opaque synthetic paper comprising a stretched film of a propylene-based resin containing an inorganic fine powder, such as calcined clay or calcium carbonate (as disclosed in U.S. Pat. No. 4,318,950), and a coated synthetic paper prepared by coating a transparent polyethylene terephthalate or polyolefin film with a pigment coating agent containing a binder and an inorganic fine powder, such as silica or calcium carbonate, to impart whiteness and dye-receptivity.

Taking into consideration after-use properties of an image-receiving sheet with a transferred dye image on, for example, suitability to copying, writability with a pencil, and record preservability, a synthetic paper comprising a microvoid-containing stretched film of a polyolefin resin containing an inorganic fine powder is preferred as a support from the standpoint of strength, dimensional stability, and contact with a printing head, as disclosed in JP-A-60-245593, JP-A-61-112693 and JP-A-63-193836 (the term "JP-A" as used herein means an "unexamined published Japanese patent application").

In this type of synthetic paper, microvoids are formed by stretching an inorganic fine powder-containing polyolefin resin film at a temperature lower than the melting point of the polyolefin resin so as to provide opacity, softness to the touch, intimate contact with a printing head, and smoothness in paper feed or discharge.

With the recent rapid advancement in speeding up of printing on a thermal transfer recording apparatus, a thermal transfer image-receiving sheet, particularly one capable of multiple transfer as disclosed in JP-A-63-222891, has been required to provide an image of high density with satisfactory gradation even with a middle tone pulse width (7 to 9 msec).

It is a common knowledge in the art that printing density can be increased with an increase in surface smoothness of an image-receiving sheet. If a compounding ratio of an inorganic fine powder is reduced in an attempt to increase surface smoothness of synthetic paper as a support, the void formed upon stretching will be reduced in number, resulting in a reduction in cushioning effect. It follows that the image density is reduced as observed in Comparative Example 1 of JP-A-63-222891 discussed above.

SUMMARY OF THE INVENTION

An object of the present invention is to provide a thermal transfer image-receiving sheet comprising a support having excellent surface smoothness while retaining sufficient cushioning effect so as to provide an image having high density even when used in high-speed printing.

The present invention provides a thermal transfer image-receiving sheet comprising (1) a support comprising (a) a surface layer comprising a biaxially stretched film of a thermoplastic resin containing from 2 to 60% by weight of titanium dioxide fine powder and (b) a base layer comprising a biaxially stretched microporous film of a thermoplastic resin containing from 10 to 45% by weight of an inorganic fine powder and (2) an image-receiving layer provided on surface layer (a) of support (1), in which support (1) has a void volume of from 30 to 60% calculated according to formula:

$$\text{Void Volume (\%)} = \frac{\text{Density of Unstretched Film} - \text{Density of Stretched Film}}{\text{Density of Unstretched Film}} \times 100$$

and a density of from 0.50 to 0.78 g/cm$^3$, and surface layer (a) of support (1) has a center-line average roughness (Ra) of not more than 0.5 μm and a Bekk's smoothness of from 4,000 to 100,000 seconds as measured according to JIS P-8119.

DETAILED DESCRIPTION OF THE INVENTION

Figure 1:
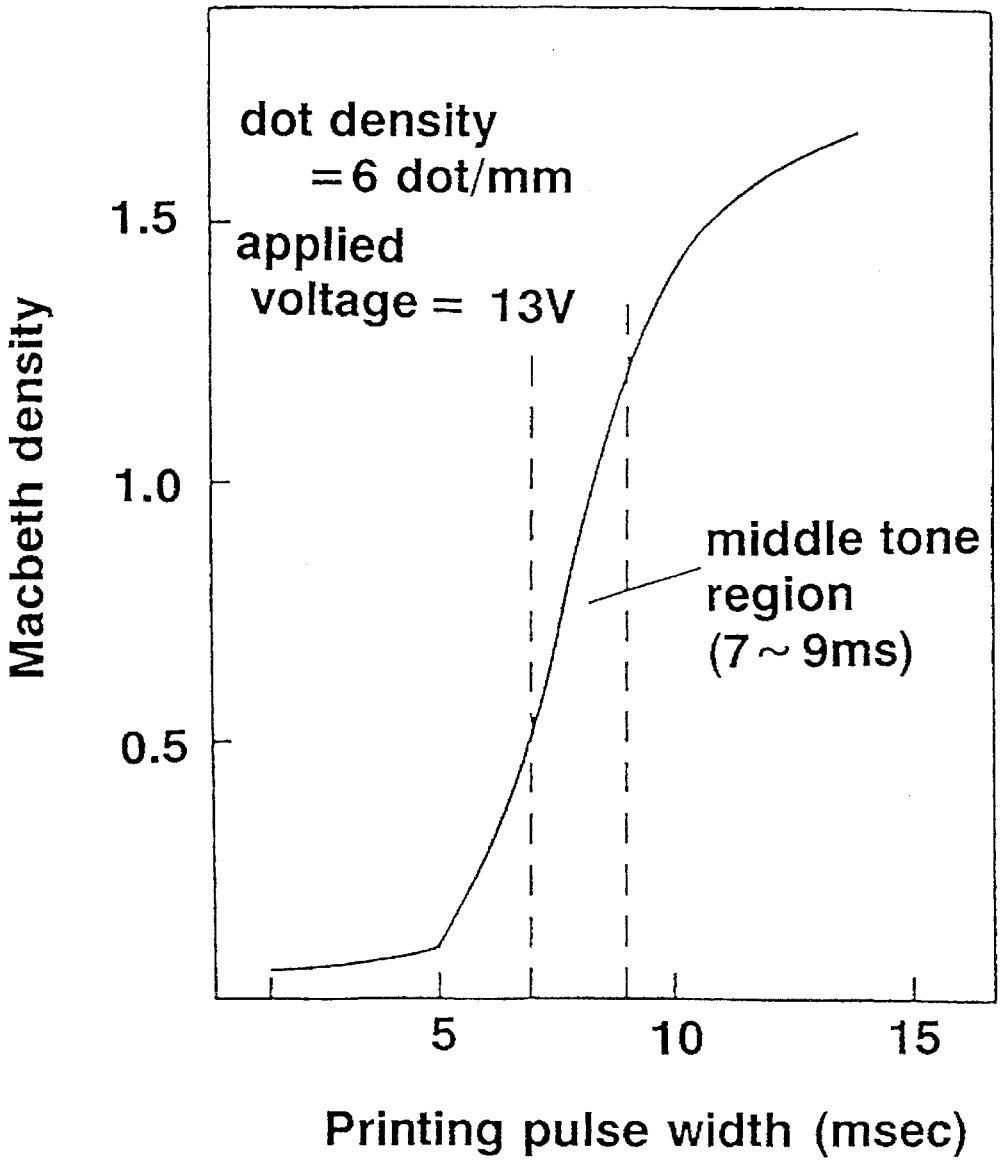
FIG. 1 is a graph of transferred image Macbeth density vs. printing pulse width.

The thermoplastic resin which can used in both base layer (b) and surface layer (a) can be polyolefins, such as polyethylene, polypropylene, an ethylene-propylene copolymer, an ethylene-vinyl acetate copolymer, a propylene-butene-1 copolymer, poly(4-methylpentene-1), and polystyrene; polyamide resins, such as nylon 6 and nylon 66; and polyesters, such as polyethylene terephthalate and polybutylene phthalate. From the standpoint of cost and gloss, propylene-based resins are preferred, such as a propylene homopolymer, an ethylene-propylene random copolymer having an ethylene content of from 0.5 to 8% by weight, and an ethylene-propylene-butene-1 random copolymer having an ethylene content of from 0.5 to 8% by weight, a butene-1 content of from 4 to 12% by weight, and a propylene content of from 80 to 95.5% by weight.

The inorganic fine powder which is incorporated into the thermoplastic resin for base layer (b) can be powders of calcium carbonate, calcined clay, diatomaceous earth, talc, barium sulfate, aluminum sulfate or silica. The inorganic fine powder to be incorporated into the thermoplastic resin for surface layer (a) can be a titanium dioxide powder. Titanium dioxide to be used may be either a rutile type or an anatase type. In order that surface layer (a) should have a center-line average roughness (Ra) of not more than 0.5 μm and a Bekk's smoothness between 4,000 and 100,000 seconds, the inorganic powder in base layer (b) preferably has an average particle size of not greater than 3 μm, more preferably from 0.1 to 3 μm, still preferably from 0.1 to 2 μm, and the titanium dioxide powder in surface layer (a) preferably has an average particle size of not greater than 1 μm, more preferably from 0.1 to 1 μm, still preferably from 0.1 to 0.5 μm.

Figure 2:
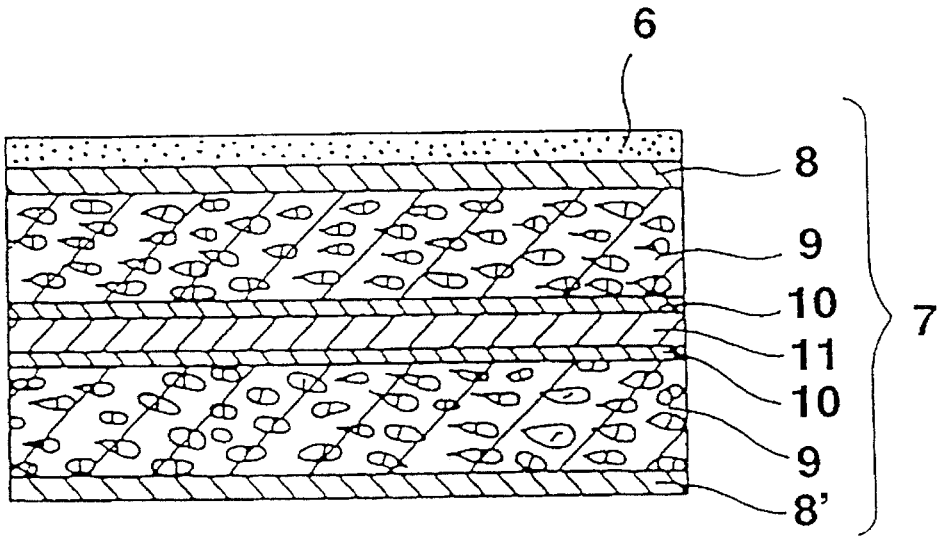
FIG. 2 is a cross section of the thermal transfer image-receiving sheet according to the present invention.
Figure 3:
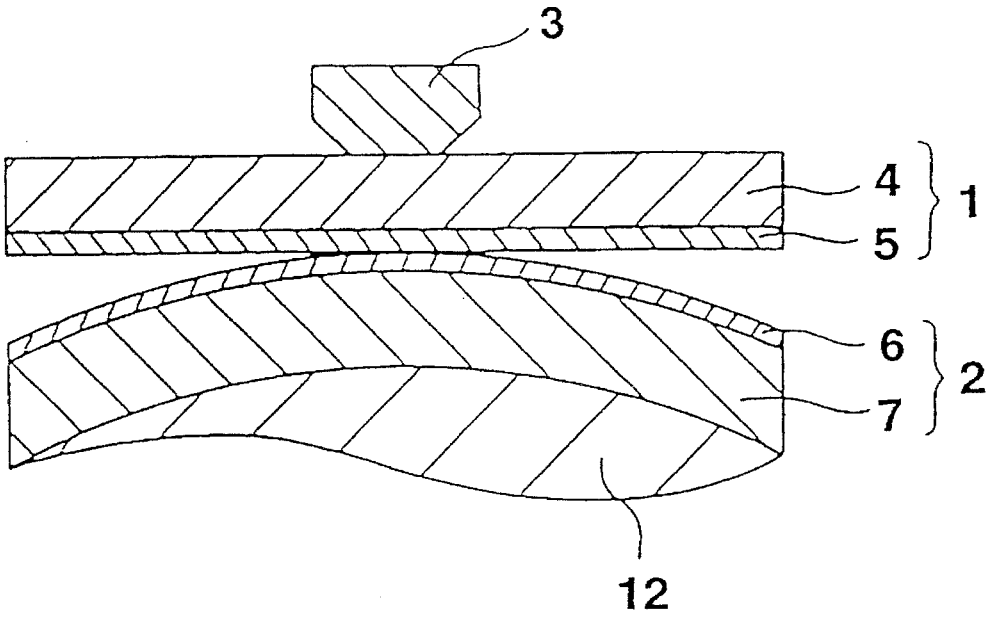
FIG. 3 is a schematic view illustrating a thermal transfer recording system.

If desired, in addition to base layer (b) and surface layer (a), the support may have a backing layer comprising, for example, pulp paper or a transparent or opaque polyethylene terephthalate film, and a back surface layer comprising a uniaxially stretched polypropylene film containing 8 to 55% by weight of an inorganic fine powder, the back surface layer being provided on the side opposite to surface layer (a). For example, support 7 shown in FIG. 2 comprises a pair of laminate films, adhered in a symmetrical manner with pulp paper 11 as an intermediate layer, the laminate films each having a three-layered structure composed of surface layer 8 comprising a biaxially stretched propylene-based resin film having a center-line average roughness of not more than 0.5μm and a Bekk's smoothness of from 4,000 to 100,000 seconds, base layer 9 comprising a biaxially stretched microporous film of an inorganic fine powder-containing propylene-based film, and back surface layer 10 comprising a biaxially stretched propylene-based resin film. Image-receiving layer 6 is formed on one of surface layers 8 and 8' to provide a thermal transfer image-receiving sheet according to the present invention.

Surface layer (a) of the support preferably has a thickness exceeding 0.5 μm, and still preferably a thickness of from 1 to 15 μm. The titanium dioxide content in surface layer (a) is from 2 to 60% by weight, preferably from 3 to 30% by weight. If it is less than 2% by weight, the effect of increasing color density is not produced. If the titanium dioxide content exceeds 60% by weight, the dispersibility of the powder is too low to make the support surface smooth, which leads to a reduction in smoothness of image-receiving layer 6.

The support of the present invention is prepared by, for example, melt-kneading a thermoplastic resin containing from 2 to 60% by weight of titanium dioxide powder and a thermoplastic resin containing from 10 to 45% by weight of an inorganic fine powder in separate extruders, feeding the molten resins to the same die, extruding the molten laminate into a laminate film, cooling the laminate film to a temperature lower than the melting point of the thermoplastic resin by 30 to 100° C., re-heating the laminate film to a temperature lower than the melting point by 10 to 30° C., and stretching in the machine direction to a stretch ratio of from 4 to 8 and in the transverse direction to a stretch ratio of from 5 to 12, either simultaneously or successively.

The support may also be obtained by preparing a biaxially stretched film of a thermoplastic resin containing from 2 to 60% by weight of titanium dioxide powder and a biaxially stretched film of a thermoplastic resin containing from 10 to 45% by weight of an inorganic fine powder by using separate extruders and separate stretching machines and then laminating the two stretched films using an adhesive.

Surface layer (a) of support 7, on which image-receiving layer 6 is to be provided, has a center-line average roughness (Ra) of not more than 0.5 μm, preferably from 0.45 to 0.30 μm, as measured in accordance with JIS B0601 and a Bekk's smoothness of from 4,000 to 100,000 sec, preferably from 7,000 to 70,000 sec, still preferably from 15,000 to 45,000 sec. The support as a whole has a void volume of from 30 to 60%, preferably from 35 to 55%, and a density of not more than 0.78 g/cm$^3$, preferably not less than 0.55 g/cm$^3$ and less than 0.70 g/cm$^3$. The higher the Bekk's smoothness of surface layer (a), the more intimate the contact between the image-receiving sheet and a thermal head to give a higher image density. The higher the void volume and the lower the density, the higher the cushioning effect of the support and the more intimate the contact between the image-receiving sheet and a thermal head to give a higher image density.

As long as the above-described conditions are met, an image-receiving sheet exhibiting high performance in high-speed printing is obtained. That is, a high-density clear image can be obtained at high sensitivity even with reduced printing energy.

Since base layer (b) contains microvoids formed around inorganic fine particles on stretching to make a contribution to satisfactory cushioning effect, the image-receiving sheet can be brought into intimate contact with a thermal head to ensure high-density color formation. Further, the presence of titanium dioxide particles in surface layer (a) increases the degree of whiteness of the support to provide a high density image especially in the middle tone region having a pulse width of from 7 to 9 msec.

The support usually has a thickness of from 40 to 300 μm.

Materials for forming a thermal transfer image-receiving layer preferably include high polymers, such as acrylic resins and polyolefin resins, which are particularly suited for receiving heat-fusible color formers containing a pigment; and high polymers, such as polyesters, and active clay, which are particularly dyeable using subliming or vaporizing dyes.

Preferred of these materials are (a) an acrylic copolymer resin, (b) a mixture of (1) an acrylic copolymer resin, (2) an amino compound having an amino group, and (3) an epoxy compound, and (c) a mixture of (a) or (b) and an inorganic or organic filler.

Monomers suitable to produce the acrylic copolymer resin as (a) or component (1) in (b) include dimethylaminoethyl methacrylate, diethylaminoethyl methacrylate, dibutylaminoethyl acrylate, dimethylaminoethyl acrylamide, diethylaminoethyl methacrylamide, and dimethylaminoethyl methacrylamide.

Other vinyl monomers suitable for producing acrylic copolymer resins include styrene, methyl methacrylate, ethyl acrylate, n-butyl acrylate, t-butyl acrylate, ethyl methacrylate, vinyl chloride, ethylene, acrylic acid, methacrylic acid, itaconic acid, acrylonitrile, and methacrylamide.

Examples of amino compounds as component (2) in (b) include polyalkylenepolyamines, e.g., diethylenetriamine and triethylenetetramine, polyethyleneimine, ethyleneurea, an epichlorohydrin adduct of polyamine-polyamide (e.g., "Kymene-557H" produced by Dick-Hercules and "AF-100" produced by Arakawa Rinsan Kagaku Kogyo K.K.), and an aromatic glycidyl ether or ester adduct of polyamine-polyamide (e.g., "Sanmide 352", "Sanmide 351" and "X-2300-75" all produced by Sanwa Kagaku K.K., and "Epicure-3255" produced by Shell Kagaku K.K.).

Typical examples of epoxy compounds as component (3) in (b) include bisphenol A diglycidyl ether, bisphenol F diglycidyl ether, phthalic acid diglycidyl ester, polypropylene glycol diglycidyl ether, and trimethylolpropane triglycidyl ether.

Examples of inorganic fillers as a component in (c) include inorganic pigments, such as synthetic silica (e.g., white carbon), calcium carbonate, clay, talc, aluminum sulfate, titanium dioxide, and zinc oxide, each having an average particle size of 0.5 μm or less, more preferably from 0.05 to 0.5 μm. Synthetic silica (e.g., white carbon) and precipitated calcium carbonate, each having an average particle size of 0.2 μm or less are preferred.

Suitable examples of organic fillers as a component in (c) include fine particles of various high polymers preferably having a particle diameter of 10 μm or less, more preferably from 0.05 to 3 μm. Examples of high polymers include methyl cellulose, ethyl cellulose, polystyrene, polyurethane, urea-formaldehyde resins, melamine resins, phenolic resins, iso-(or diiso-)butylene/maleic anhydride copolymers, styrene/maleic anhydride copolymers, polyvinyl acetate, polyvinyl chloride, vinyl chloride/vinyl acetate copolymers, polyesters, polyacrylic alkylesters, polymethacrylic alkylesters, and styrene/butadiene/acrylate copolymers.

The inorganic filler, in particular, may be subjected to a surface treatment with a nonionic, cationic or amphoteric surface active agent, such as Turkey red oil (sulfonated oil), sodium dodecylbenzenesulfate, organic amines, or metallic soaps such as sodium lignin sulfonate, so as to have improved wettability by inks of the thermal transfer recording material.

These fillers are usually used in a proportion of not more than 30% by weight.

A mixed resin of a saturated polyester and a vinyl chloride-vinyl acetate copolymer is also suitable as a material of an image-receiving layer. Examples of saturated polyesters include "Vylon 200, 290 or 600" produced by Toyobo Co., Ltd., "KA-1038C" produced by Arakawa Kagaku K.K., and "TP 220 or 235" produced by Nippon Gosei K.K. The vinyl chloride-vinyl acetate copolymer preferably has a vinyl chloride content of from 85 to 97% by weight and a degree of polymerization of from about 200 to 800. The vinyl chloride-vinyl acetate copolymer may further comprise a vinyl alcohol unit, a maleic acid unit, etc. Examples of useful vinyl chloride-vinyl acetate copolymers include "S-Lec A, C or M" produced by Sekisui Chemical Co., Ltd., "Vinylite VAGH, VYHH, VMCH, VYHD, VYLF, VYNS, VMCC, VMCA, VAGD, VERR or VROH" produced by Union Carbide Corp., and "Denka Vinyl 1000GKT, 1000L, 1000CK, 1000A, 1000LK$_2$, 1000AS, 1000MT$_2$, 1000CSK, 1000CS, 1000GK, 1000GSK, 1000GS, 1000LT$_2$, 1000D or 1000W" produced by Denki Kagaku Kogyo K.K. A preferred mixing ratio of the saturated polyester to vinyl chloride-vinyl acetate copolymer is 100 to 900:100 by weight.

The above-described material forming a thermal transfer image-receiving layer is applied on surface layer (a) of the support using a general coating machine, e.g., a blade coater, an air knife coater, a roll coater, and a bar coater, or a size press, a gate roll machine, etc. and dried to form a thermal transfer image-receiving layer having a thickness of from 0.2 to 20 μm, preferably from 0.5 to 10 μm.

If desired, the resulting thermal transfer image-receiving sheet may be subjected to calendering to further improve the surface smoothness of the image-receiving layer.

The present invention is now illustrated in greater detail with reference to the following Examples, but it should be understood that the present invention is not to be construed as limited thereto. All the percents and parts are given by weight unless otherwise indicated.

The physical properties of the supports prepared were measured as follows.

1) Center-line Average Roughness (Ra):

Measured with a three-dimensional center-line roughness meter "SE-3AK" manufactured by Kosaka Kenkyusho and an analyzer "Model SPA-11".

2) Bekk's Smoothness:

Measured in accordance with JIS P8119.

EXAMPLE 1

Preparation of Support:

A composition (A) comprising 95% of a propylene homopolymer having a melt flow rate (MFR) of 4 g/10 min and a melting point of about 164° to 167° C. and 5% of rutile type titanium dioxide having an average particle size of 0.3 μm, a composition (B) comprising 65% of a propylene homopolymer having an MFR of 0.8 g/10 min, 10% of high-density polyethylene, and 25% of calcium carbonate having an average particle size of 1.5 μm, and a propylene homopolymer (C) having an MFR of 4 g/10 min were each melt-kneaded at 260° C. in separate extruders, fed to the same die, laminated within the die, and co-extruded into sheeting. The extruded sheet was cooled with a cooling roll to about 60° C. to obtain a laminate sheet.

The laminate sheet was heated to about 140° C. and stretched in the machine direction at a stretch ratio of 5 by making use of the difference in peripheral speed among plural rolls. The stretched film was again heated to about 158° C. and stretched in the transverse direction at a stretch ratio of 8.5 using a tenter. The resulting biaxially stretched film was annealed at 165° C., followed by cooling to 60° C. Both edges of the film were trimmed to obtain a support having a three-layered structure (A/B/C=3.0 μm/54 μm/3.0 μm).

Surface layer A of the resulting support had a Bekk's smoothness of 38,200 sec and a center-line average roughness (Ra) of 0.35 μm. The support had a void volume of 46% and a density of 0.61 g/cm$^3$ as a whole.

Formation of Image-Receiving layer:

A coating composition having the following formulation was applied on surface layer A of the above-prepared support using a wire bar coater to a dry thickness of 4 μm and dried at 80° C. for 3 seconds to obtain a thermal transfer image-receiving sheet.

| Coating Composition Formulation: | |
|---|---|
| Saturated Polyester: | |
| "Vylon 200" produced by Toyobo Co., Ltd.; Tg: 67° C. | 5.3 parts |
| "Vylon 290" produced by Toyobo Co., Ltd.; Tg: 77° C. | 5.3 parts |
| Vinyl chloride-vinyl acetate copolymer ("Vinylite VYHH" produced by Union Carbide Corp.) | 4.5 parts |
| Titanium oxide ("KA-10" produced by Titan Kogyo K.K.) | 1.5 parts |
| Amino-modified silicone oil ("KF-393" produced by Shin-Etsu Silicone Co., Ltd.) | 1.1 parts |
| Epoxy-modified silicone oil ("X-22-343" produced by Shin-Etsu Silicone Co., Ltd.) | 1.1 parts |
| Toluene | 30 parts |
| Methyl ethyl ketone | 30 parts |
| Cyclohexane | 22 parts |

Printing:

The resulting image-receiving sheet was printed using a dot printer produced by Ohkura Electric Co., Ltd. (dot density: 6 dot/mm; applied voltage: 13 V) while varying the printing pulse width from 0 to 15 msec. The Macbeth density of the transferred dye image was measured. The change of the density with change of pulse width is shown in FIG. 1. The Macbeth density at a pulse width of 8 msec (middle tone region) is shown in Table 2. The gradation of the resulting image was evaluated visually and rated as follows.

5 . . . Very good

4 . . . Good

3 . . . Not a problem for practical use

2 . . . Interferes with practical use

1 . . . Poor

The image unevenness (roughness) of the transferred image was evaluated visually and rated as follows.

5 . . . No image unevenness at all

4 . . . No image unevenness

3 . . . Not a problem for practical use

2 . . . Interferes with practical use

1 . . . Considerable image unevenness

The results of the evaluation are shown in Table 2.

EXAMPLES 2 TO 7 AND COMPARATIVE EXAMPLES 1 AND 2

Supports having the physical properties shown in Table 1 below were prepared in the same manner as described in Example 1, except for changing the composition of each layer and the die aperture.

An image-receiving layer was formed on each support in the same manner as described in Example 1 to obtain a thermal transfer image-receiving sheet. The Macbeth density, gradation, and image unevenness of the transferred image formed on the image-receiving sheet were evaluated in the same manner as described in Example 1. The results obtained are shown in Table 2.

EXAMPLE 8

A double-layered support having the physical properties shown in Table 1 below was prepared in the same manner as described in Example 1, except that the propylene homopolymer as layer C was not used.

In the same manner as described in Example 1, an image-receiving layer was formed on the support to obtain a thermal transfer image-receiving sheet, and the Macbeth density, gradation, and image unevenness of the transferred image formed on the image-receiving sheet were evaluated. The results obtained are shown in Table 2.

EXAMPLE 9

A support having the physical properties shown in Table 1 below was prepared in the same manner as described in Example 1, except for replacing calcium carbonate with calcined clay having an average particle size of 0.8 μm.

In the same manner as described in Example 1, an image-receiving layer was formed on the support to obtain a thermal transfer image-receiving sheet, and the Macbeth density, gradation, and image unevenness of the transferred image formed on the image-receiving sheet were evaluated. The results obtained are shown in Table 2.

TABLE 1

| Example | Surface Layer A | | Base Layer B | | | Back Layer C | | Layer Thickness A/B/C | Ra | Bekk's Smoothness | Void Volume | Density | Whiteness |
|---|---|---|---|---|---|---|---|---|---|---|---|---|---|
| No. | PP* | $TiO_2$ | PP | HDPE** | $CaCO_3$ | PP | $CaCO_3$ | (μm) | (μm) | (sec) | (%) | (g/cm$^3$) | (%) |
| Example 1 | 95 | 5 | 65 | 10 | 25 | 100 | — | 3.0/54/3.0 | 0.35 | 38,200 | 46 | 0.61 | 96 |
| Example 2 | 95 | 5 | 65 | 10 | 25 | 100 | — | 3.0/54/3.0 | 0.38 | 21,000 | 37 | 0.71 | 96 |
| Example 3 | 85 | 15 | 65 | 10 | 25 | 100 | — | 3.0/54/3.0 | 0.33 | 48,500 | 48 | 0.62 | 97 |
| Example 4 | 95 | 5 | 55 | 10 | 35 | 100 | — | 3.0/54/3.0 | 0.35 | 39,600 | 48 | 0.60 | 96 |
| Example 5 | 95 | 5 | 65 | 10 | 25 | 100 | — | 1.0/58/1.0 | 0.34 | 27,300 | 49 | 0.61 | 96 |
| Example 6 | 95 | 5 | 65 | 10 | 25 | 100 | — | 8.0/44/8.0 | 0.32 | 50,700 | 45 | 0.62 | 97 |
| Example 7 | 95 | 5 | 65 | 10 | 25 | 70 | 30 | 3.0/54/3.0 | 0.35 | 36,500 | 48 | 0.61 | 96 |
| Example 8 | 95 | 5 | 65 | 10 | 25 | — | — | 3.0/57/— | 0.34 | 37,100 | 49 | 0.62 | 96 |
| Example 9 | 95 | 5 | 65 | 10 | 25 (clay) | 100 | — | 3.0/54/3.0 | 0.38 | 7,800 | 42 | 0.63 | 96 |
| Compara. Example 1 | 99 | 1 | 65 | 10 | 25 | 100 | — | 3.0/54/3.0 | 0.38 | 15,200 | 46 | 0.63 | 95 |
| Compara. Example 2 | 35 | 65 | 65 | 10 | 25 | 100 | — | 3.0/54/3.0 | 0.72 | 2,400 | 49 | 0.63 | 97 |
| Compara. Example 3 | Example 2 of JP-A-3-216386 | | | | | | | 1.0/58/1.0 | 0.39 | 4,500 | 29 | 0.68 | 95 |
| Compara. Example 4 | Example 1 of JP-A-63-222891 | | | | | | | | 0.45 | 800 | 31 | 0.76 | 96 |

Note:
*Propylene homopolymer
**High-density polyethylene

TABLE 2

| Example No. | Macbeth Density* | Gradation | Image Unevenness |
|---|---|---|---|
| Example 1 | 0.85 | 5 | 5 |
| Example 2 | 0.82 | 5 | 5 |
| Example 3 | 0.86 | 5 | 5 |
| Example 4 | 0.86 | 5 | 5 |
| Example 5 | 0.83 | 4 | 5 |
| Example 6 | 0.88 | 5 | 5 |
| Example 7 | 0.85 | 5 | 5 |
| Example 8 | 0.85 | 5 | 5 |
| Example 9 | 0.82 | 4 | 5 |
| Compara. Example 1 | 0.70 | 5 | 5 |
| Compara. Example 2 | 0.86 | 3 | 1 |
| Compara. Example 3 | 0.68 | 5 | 5 |
| Compara. Example 4 | 0.66 | 3 | 5 |

EXAMPLE 10

A composition (A) comprising 95% of a propylene homopolymer having an MFR of 4 g/10 min and a melting point of 164° to 167° C. and 5% of titanium dioxide having an average particle size of 0.3 μm, a composition (B) comprising 65% of a propylene homopolymer having an MFR of 0.8 g/10 min, 10% of high-density polyethylene, and 25% of calcium carbonate having an average particle size of 1.5 μm, and a propylene homopolymer (C) having an MFR of 4 g/10 min were each melt-kneaded in separate extruders at 260° C., fed to the same die, laminated within the die, extruded into sheeting, and cooled with a cooling roll to about 60° C. to obtain a laminate sheet. The extruded laminate sheet was heated to about 140° C. and stretched in the machine direction at a stretch ratio of 5 by using the difference in peripheral speed among plural rolls to obtain a three-layered stretched film.

A composition (D) comprising 55% of a propylene homopolymer having an MFR of 4 g/10 min and 45% of calcium carbonate having an average particle size of 1.5μm was melt-kneaded in an extruder and extruded into sheeting. The extruded sheet D was laminated on back surface layer (C) of the above-prepared 3-layered stretched sheet, followed by cooling to 60° C. The laminate sheet was re-heated to 160° C., at which the sheet was stretched in the transverse direction at a stretch ratio of 8.5 using a tenter, annealed at 165° C., and cooled to 60° C., followed by trimming to obtain a support having a 4-layered structure (A/B/C/D =3 μm/54 μm/3 μm/20 μm).

Surface layer A of the resulting support had an Ra of 0.38 μm and a Bekk's smoothness of 33,600 sec, and the support had a density of 0.68 g/cm$^3$ overall.

A thermal transfer image-receiving layer was formed on surface layer A of the support in the same manner as in Example 1 to prepare a thermal transfer image-receiving sheet. The resulting image-receiving sheet was evaluated in the same manner as in the foregoing Examples. As a result, the transferred image exhibited satisfactory properties and had a Macbeth density of 0.83, gradation rated 4, and image unevenness rated 5.

EXAMPLE 11

The support obtained in Example 1 was laminated on each side of 60 μm thick fine paper with layer A outside using a polyether polyol/polyisocyanate liquid adhesive to prepare a support having a 7-layered structure (A/B/C/fine paper/C/B/A) and a density of 0.75 g/cm$^2$.

A thermal transfer image-receiving layer was formed on one of surface layers A of the resulting support in the same manner as in Example 1 to prepare a thermal transfer image-receiving sheet. The resulting image-receiving sheet was evaluated in the same manner as in Example 1. As a result, the transferred image had a Macbeth density of 0.84, gradation rated 5, and image unevenness rated 5.

EXAMPLE 12

The support prepared as described in Example 2 was laminated on each side of 50 μm thick white polyethylene terephthalate (PET) film with layer A outside using a polyether polyol/polyisocyanate liquid adhesive to prepare a support having a 7-layered structure (A/B/C/PET/C/B/A) and a density of 0.76 g/cm$^2$.

A thermal transfer image-receiving layer was formed on one of surface layers A of the resulting support in the same manner as described in Example 1 to prepare a thermal transfer image-receiving sheet. The resulting image-receiving sheet was evaluated in the same manner as in Example 1. As a result, the transferred image had a Macbeth density of 0.85, the gradation rated 5, and image unevenness rated 5.

As described and demonstrated above, the thermal transfer image-receiving sheet according to the present invention provides excellent cushioning effect on account of the number of microvoids present in the support thereof. Further, titanium dioxide present in the surface layer of the support makes a contribution to high color density in a middle tone region. As a result, the image-receiving sheet has high sensitivity to provide a clear image having a high density even with reduced printing energy.

While the invention has been described in detail and with reference to specific examples thereof, it will be apparent to one skilled in the art that various changes and modifications can be made therein without departing from the spirit and scope thereof.

What is claimed is:

1. A thermal transfer image-receiving sheet comprising (1) a support comprising (a) a surface layer comprising a biaxially stretched film of a thermoplastic resin containing from 2 to 60% by weight of titanium dioxide fine powder and (b) a base layer comprising a biaxially stretched microporous film of a thermoplastic resin containing from 10 to 45% by weight of an inorganic fine powder and (2) an image-receiving layer provided on surface layer (a) of support (1), in which support (1) has a void volume of from 30 to 60% calculated according to formula:

$$\text{Void Volume (\%)} = \frac{\text{Density of Unstretched Film} - \text{Density of Stretched Film}}{\text{Density of Unstretched Film}} \times 100$$

and a density of from 0.50 to 0.78 g/cm$^3$, and surface layer (a) of support (1) has a center-line average roughness (Ra) of not more than 0.5 μm and a Bekk's smoothness of from 4,000 to 100,000 seconds as measured according to JIS P-8119.

2. A thermal transfer image-receiving sheet as claimed in claim 1, wherein surface layer (a) of support (1) has a thickness of from 1 to 15 μm.

3. A thermal transfer image-receiving sheet as claimed in claim 1, wherein said inorganic fine powder in base layer (b) of support (1) is selected from the group consisting of calcium carbonate, calcined clay, diatomaceous earth, talc, barium sulfate, aluminum sulfate, and silica and has a particle size of from 0.1 to 3 μm.

4. A thermal transfer image-receiving sheet as claimed in claim 1, wherein said titanium dioxide in surface layer (a) of support (1) has a particle size of from 0.1 to 1 μm.

5. A thermal transfer image-receiving sheet as claimed in claim 1, wherein support (1) further comprises (c) a back layer comprising a biaxially stretched film of a thermoplastic resin containing from 2 to 60% by weight of titanium dioxide fine powder, said back layer being provided on the side opposite to surface layer (a).

6. A thermal transfer image-receiving sheet as claimed in claim 1, wherein said thermoplastic resin is polypropylene.

7. A thermal transfer image-receiving sheet as claimed in claim 6, wherein support (1) further comprises a back surface layer comprising a uniaxially stretched film of polypropylene containing from 8 to 55% by weight of an inorganic fine powder, said back surface layer being provided on the side opposite to surface layer (a).

8. A thermal transfer image-receiving sheet as claimed in claim 1, wherein support (1) has a thickness of from 40 to 300 μm, and image-receiving layer (2) has a thickness of from 0.2 to 20 μm.

* * * * *